United States Patent [19]

Moss

[11] 4,285,326

[45] Aug. 25, 1981

[54] FIREPLACE CONSTRUCTION WITH ADAPTABLE COMBUSTION AIR INLET

[75] Inventor: Robert G. Moss, Wisconsin Rapids, Wis.

[73] Assignee: Preway Inc., Wisconsin Rapids, Wis.

[21] Appl. No.: 941,007

[22] Filed: Sep. 11, 1978

[51] Int. Cl.[3] ..... F24B 7/00

[52] U.S. Cl. ..... 126/121; 126/131; 126/129; 237/51

[58] Field of Search ..... 126/288, 77, 112, 124, 126/120, 129, 131; 237/51

[56] References Cited

U.S. PATENT DOCUMENTS

| | | | |
|---|---|---|---|
| 921,019 | 5/1909 | Speer | 126/112 X |
| 2,103,171 | 12/1937 | Nilson | 126/120 |
| 2,863,443 | 12/1958 | Hoffman | 126/121 |
| 3,970,067 | 7/1976 | Vaughn | 126/120 |
| 4,004,731 | 1/1977 | Zung | 237/51 |
| 4,068,649 | 1/1978 | Johnson | 126/120 |
| 4,074,679 | 2/1978 | Jensen | 126/121 |
| 4,095,581 | 6/1978 | Billmeyer et al. | 126/120 |
| 4,112,913 | 9/1978 | Shimek et al. | 126/120 |
| 4,117,827 | 10/1978 | Billmeyer | 126/288 X |
| 4,179,065 | 12/1979 | Zung | 237/51 |

*Primary Examiner*—Larry Jones

*Attorney, Agent, or Firm*—Wegner, Stellman, McCord, Wood & Dalton

[57] ABSTRACT

A prebuilt fireplace construction for installation in a living space includes a housing, a firebox within the housing with an open forward side adapted to be sealed by glass doors, an outlet for combustion gases, an inlet for combustion air and has a base structure supporting the housing through which an inlet duct for combustion air extends. One end of the combustion air duct is connected to the combustion air inlet. The other end of the duct may connect to an optionally used air intake conduit so that exterior air may be delivered to the combustion air inlet, or receive air from a room interior which is drawn into the firebox through the base structure. A damper within the duct permits adjustment of external air flow into the firebox from either source and can be positioned to close the combustion air duct to prevent drafts when the fireplace is not in use.

2 Claims, 3 Drawing Figures

FIREPLACE CONSTRUCTION WITH ADAPTABLE COMBUSTION AIR INLET

BACKGROUND OF THE INVENTION

This invention relates to fireplace constructions and, more particularly, to prebuilt fireplaces adapted to be installed free-standing in the room of a mobile, modular or residential house or other structure.

The use of prebuilt fireplace constructions is increasing because of the economy and the ease of installation. In such prebuilt fireplaces, it is desirable to provide a complete, free-standing fireplace structure primarily of sheet metal so as to minimize the need for additional construction during installation. Fireplaces have an outlet connected to a flue to vent combustion gas to the exterior of the structure housing the fireplace. A damper is employed to control the flow of combustion gas through the flue. Combustion air required to maintain a fire within the firebox is either drawn from the interior of the room housing the fireplace or drawn from a point exterior of the house or other structure. Where a structure, such as a mobile home, does not have sufficient ventilation, an external connection may be necessary to avoid oxygen starvation. An external connection is also preferred where heated interior air is to be conserved thereby reducing the amount of cooler exterior air drawn into the living space in which the fireplace is located.

In a prebuilt fireplace, it is desirable that means be provided to conveniently and readily adapt the fireplace to the structure in which it is installed without significantly marring the over-all design or aesthetic appearance of the fireplace.

SUMMARY OF THE INVENTION

It is, therefore, the principal object of the invention to provide a prebuilt fireplace construction having a combustion air inlet readily adapted to draw combustion air from the interior of the living space or from a point exterior of a structure, such as a house or mobile home. It is also an object of the invention to provide a fireplace in which a damper is positioned to control the combustion air path regardless of the source of combustion air.

According to the invention, a prebuilt fireplace construction includes a housing, a firebox defined within the housing having a front opening adapted to be sealed by glass doors, a base structure for supporting the housing above a supporting surface, and a combustion air duct having one end within the base structure adapted to optionally receive an intake conduit communicating exteriorly of the house or other structure and having its other end communicating with the firebox through an inlet structure.

In an exemplary embodiment of the invention, a damper is installed within the combustion air duct to control flow of air therethrough and to prevent unwanted drafts. The base structure is configured, as by vent openings formed therein, so that the combustion air duct can draw air from the interior of the house if desired. Where exterior air is to be utilized for combustion, an intake conduit is joined to the combustion air duct and extends through the supporting floor so that it is concealed by the base structure. The intake conduit blocks the communication of the combustion air duct with room air.

DESCRIPTION OF THE PREFERRED EMBODIMENT

Figure 1:
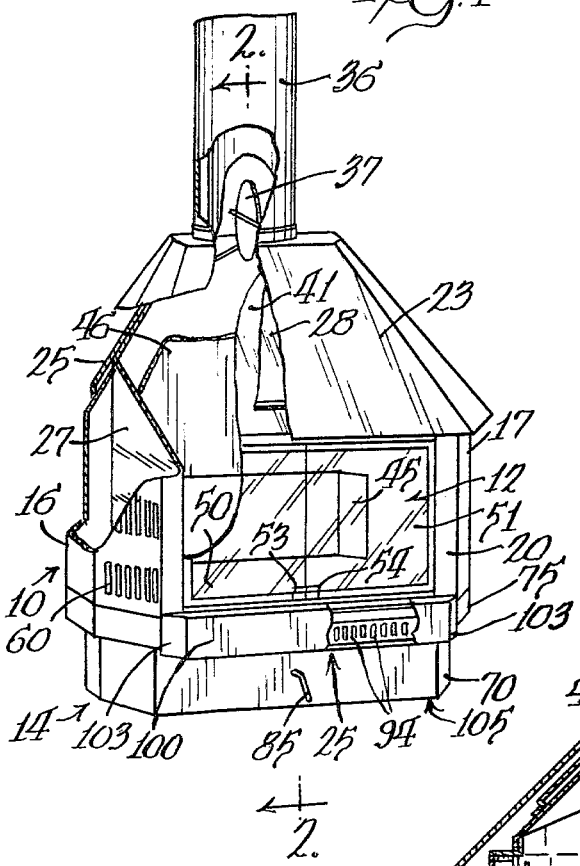
FIG. 1 is a perspective view of a fireplace construction made in accordance with the invention with parts broken away to show the internal arrangement thereof.
Figure 2:
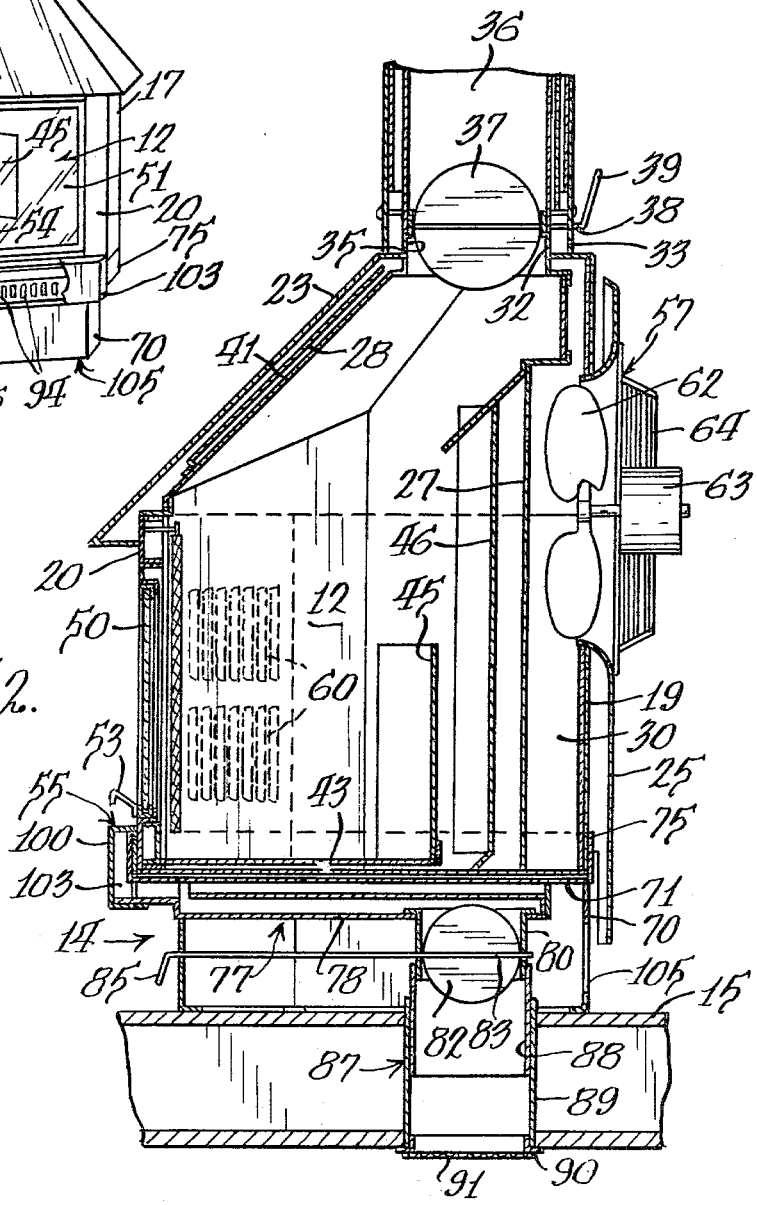
FIG. 2 is an enlarged cross-sectional view of the fireplace construction, taken along line 2—2 of FIG. 1, showing the combustion air conduit communicating exteriorly of the house or other structure and the damper therein.

With reference to FIGS. 1 and 2, a free-standing fireplace constructed in accordance with the invention is seen to broadly include a housing, generally designated 10, a firebox 12 within the housing 10 and a base structure, generally designated 14, which supports the housing 10 on the floor 15 of the structure in which the fireplace is installed.

The housing 10, which is preferably constructed from sheet metal, includes spaced side walls 16 and 17, a back wall 19, a front wall 20, a bottom wall 22 and a hood 23. Spaced rearward of the back wall 19 is a back shield 25.

The firebox 12 has a front opening generally aligned with the front opening in the front wall 20 of the housing 10. The firebox 12 is defined by a heat shield 27 and a heat shield hood 28 which are inwardly spaced from the housing 10 to define a circulating air space 30 therebetween. Concentric annular walls 32 and 33 define a combustion gas outlet 35 which is adapted to be connected to a flue 36 extending upwardly to the exterior of the building in which the fireplace is installed. Within the combustion gas outlet 35 is a disc-like damper 37 mounted for movement between various open positions and a closed position on a shaft 38 which is rotatably supported by the walls 32 and 33 and is manually operable by an external handle portion 39.

Various shields are employed within the housing 10 and the firebox 12 to control the flow of heat within the fireplace. As seen in FIG. 2, a shield 41 is disposed between the heat shield hood 28 and the hood 23 to minimize heating of the exterior surface of the hood 23. At the bottom of the firebox 12 is a hearth member 43 upon which combustion material (not shown) is placed. At the rear of the firebox 12 is a radiant shield 45 and an inner heat shield 46, which is disposed between the radiant shield 45 and the heat shield 27.

The open forward side of the firebox 12 is adapted to be optionally sealed by two transparent doors 50 and 51 having handles 53 and 54, respectively. The doors 50 and 51 are hinged to the housing 10 and overlie a combustion air inlet, generally designated 55, through which combustion air may enter the firebox 12.

A circulating air inlet, generally designated 57, communicating with the circulating air space 30 is defined at the rear of the fireplace. A circulating air outlet is defined in the respective side walls 16 and 17 of the housing 10 by a plurality of vents 60. A fan is disposed within the circulating air inlet 57 and includes a fan blade 62, a motor 63 and a mounting 64 fixed to the back shield 25. The fan is operative to draw air into the circulating air space 30 from the rear of the fireplace and force air within the circulating air space 30 laterally outward through the vents 60. As a result, the circulating air absorbs heat from the firebox 12, while remaining completely isolated from the combustion chamber within the firebox 12.

The base structure 14 includes an upright wall member 70 and a horizontal supporting member 71 at the upper end of the upright wall member 70. The upright wall member 70 has a flange 72 which rests on the floor 15. The supporting member 71 has an upright flange 75 which surrounds the lower end of the housing 10 which is carried by the supporting member 71. Defined within the base structure 14 is a combustion air duct, generally designated 77, which is bounded by the lower surface of the supporting member 71 and a surrounding body member 78. The combustion air duct 77 extends forwardly through upright wall member 70 of the base structure 14 to a position below the housing 10 beneath the combustion air inlet 55. Between the supporting member 71 and the body member 78 is a heat shield 79.

An annular extension 80 of the combustion air duct 77 is positioned at the upstream end thereof and depends downwardly from the body member 78 and rotatably supports a disc-like damper 82 mounted for movement between open and closed positions on a shaft 83. The shaft 83 extends through the front wall of the base structure 14 to enable control of air flow by manual positioning thereof via an external handle portion 85.

Figure 3:
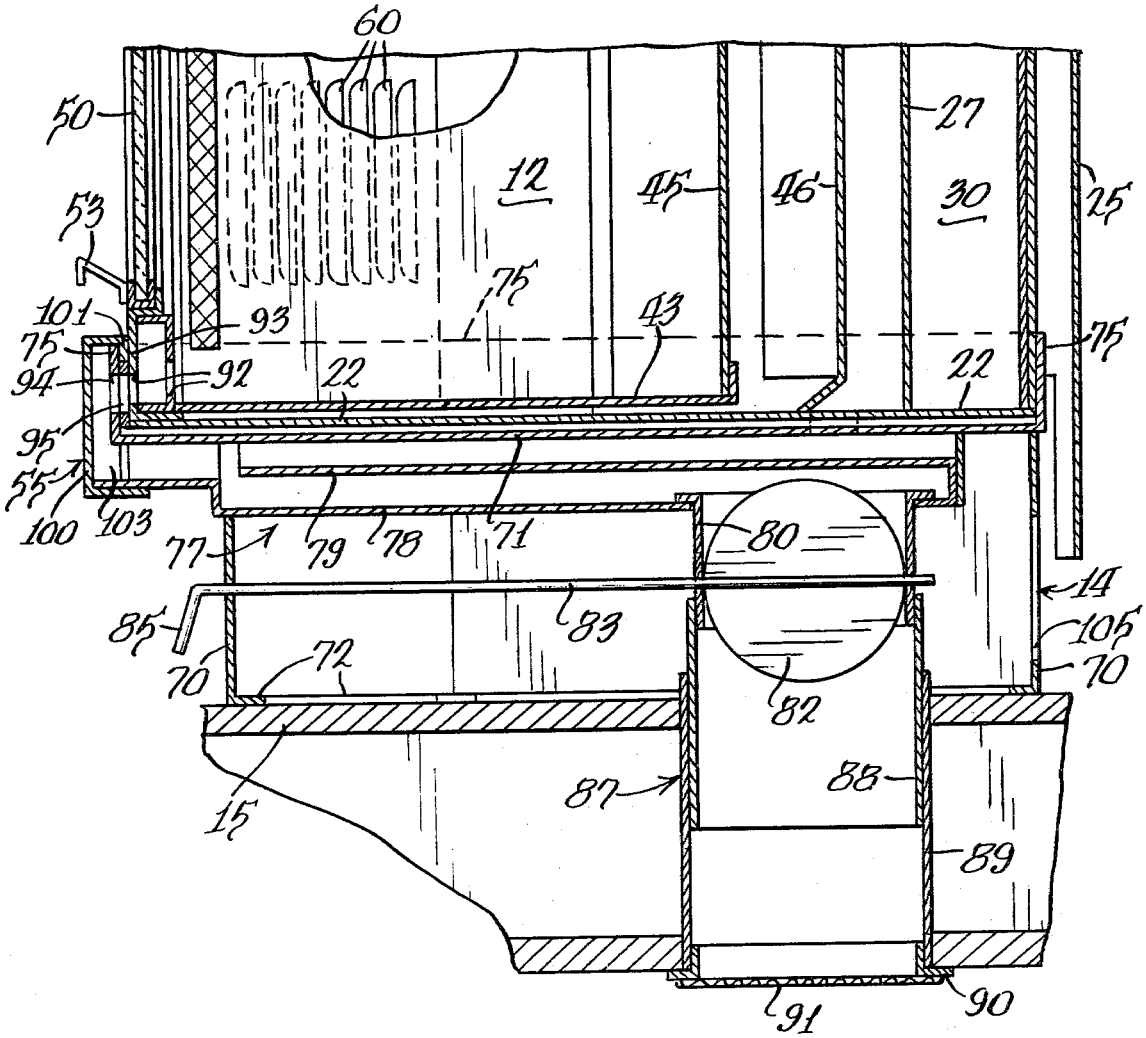
FIG. 3 is an enlarged fragmentary cross-sectional view of the lower portion of the fireplace construction shown in FIG. 2.

For supply of external air for combustion, an annular intake conduit 87 is optionally joined to the upstream duct extension 80 and extends downwardly through the open interior of the base structure 14 and the floor 15 to a point exterior of the structure housing the fireplace. As seen in FIG. 3, the intake conduit 87 has an inner portion 88 which telescopes within an outer portion 89. Consequently, the distance spanned by the intake conduit 87 may be conveniently adjusted. An intake collar 90 having a screen 91 is secured at the outer end of the intake conduit 87.

In FIGS. 1 and 3, the structure defining the combustion air inlet 55 is more clearly illustrated. The combustion air inlet 55 includes openings 92 extending through box-like front wall portion 93 and a plurality of apertures 94 extending through the flange 75.

An inlet cover conduit 100 is permanently attached to the flange 75 forward of the housing 10 to direct air from the downstream end of the combustion air duct 77 upward into the combustion air inlet 55. The inlet cover conduit 100 is attached by inserting finger portion 101 into the space between the flange 75 and the front wall portion 93 and then secured, as by welding or screws. The inlet cover conduit 100 has a generally C-shaped cross-sectional configuration with the ends 103 thereof closing the channel defined therein. The combustion air duct 77 is configured such that the body member 78 extends forwardly beyond the flange 75 so that air flows forwardly through the combustion air duct 77 upwardly between the cover conduit 100 and the flange 75 and rearwardly through the apertures 94 in the flange 75 and the openings 92 in the front wall portion 93.

When the fireplace is installed in a structure such as a mobile home which has no natural ventilation, the intake conduit 87 is utilized.

The fireplace may be employed in a residential structure having natural ventilation without using the intake conduit 87. If the intake conduit 87 is not employed to provide a source of external air, combustion air is drawn in through the open rear of the base structure 14, as shown at 105, and flows to the duct extension 80. The damper 82 disposed within the duct extension 80 is operative to control the flow of combustion air into the combustion air duct 77 leading to the firebox 12. Also, the damper 82 may be closed during nonuse of the fireplace to prevent air drafts.

I claim:

1. A fireplace assembly comprising:

a housing having a firebox with a front opening and a combustion gas outlet adapted to be in fluid communication with a flue;

door means for optionally sealing said front opening;

a base structure for supporting said housing above a supporting surface;

a combustion air inlet in said housing near the bottom of said housing through which combustion air may enter said firebox;

duct means having a downwardly-opening upstream end positioned within and at a distance above the bottom of said base structure and a downstream end positioned adjacent the bottom of said housing below said combustion air inlet;

an optionally usable intake conduit having one end removably connected to the upstream end of said duct means and its other end communicating exteriorly of the structure interior to provide fluid communication for delivery of combustion air from an external source to said duct means;

means in said base structure providing communication between the structure interior and the interior of said base structure whereby combustion air is delivered into the upstream end of said duct means from the structure interior for delivery to said combustion air inlet when the intake conduit is disconnected from said duct means; and a damper mounted in said duct means to provide selective control of the flow of combustion air through the duct means regardless of which source of air is being utilized.

2. A free-standing fireplace assembly having plural operating modes, selection of one of the operating modes permitting the source of combustion air and the rate of delivery to a fire to be controlled in accordance with the structure in which the fireplace assembly is installed, said fireplace assembly comprising:

a housing having a firebox with an open side and a combustion gas outlet adapted to be in fluid communication with a flue;

a transparent door for substantially sealing said open side;

a base structure for supporting said housing above a supporting surface including an upright wall member between said housing and the supporting surface;

a combustion air inlet in said housing near the bottom of said housing through which combustion air may enter said firebox; duct means having an upstream end positioned within and at a distance above the bottom of said base structure for opening to the interior of said base structure and a downstream end positioned adjacent the bottom of said housing and communicating with said combustion air inlet;

an optionally usable intake conduit having one end removably connected to the upstream end of said duct means and its other end communicating exteriorly of the structure interior to provide fluid communication for delivery of combustion air from an external source to said duct means;

means in said base structure providing communication between the structure interior and the interior of said base structure whereby combustion air is delivered into the upstream end of said duct means from the structure interior for delivery to said combustion air inlet when the intake conduit is disconnected from said duct means;

and a movable damper mounted in said duct means intermediate the upstream and downstream ends thereof to be in the combustion air flow path regardless of which source of air is utilized and positionable to control the flow of combustion air from either source through said duct means including complete closure of said duct means to prevent air drafts.

* * * * *